US008361572B2

(12) United States Patent
Toles et al.

(10) Patent No.: US 8,361,572 B2
(45) Date of Patent: Jan. 29, 2013

(54) COATED MEDIUM FOR INKJET PRINTING

(75) Inventors: Christopher Toles, Escondido, CA (US); Xi Zeng, San Diego, CA (US); Jason Swei, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 572 days.

(21) Appl. No.: 12/609,746

(22) Filed: Oct. 30, 2009

(65) Prior Publication Data

US 2011/0104410 A1 May 5, 2011

(51) Int. Cl.
*B41M 5/00* (2006.01)

(52) U.S. Cl. ..... 428/32.21; 428/32.34; 428/32.36; 428/32.38; 427/243

(58) Field of Classification Search ..... 428/32.21, 428/32.34, 32.36, 32.38; 427/243
See application file for complete search history.

(56) References Cited

U.S. PATENT DOCUMENTS

| | | | | |
|---|---|---|---|---|
| 5,879,442 | A * | 3/1999 | Nishiguchi et al. | 106/464 |
| 6,666,953 | B1 | 12/2003 | Gane et al. | |
| 2001/0026869 | A1 | 10/2001 | Wicher | |
| 2003/0048346 | A1 | 3/2003 | Chow | |
| 2004/0255820 | A1 | 12/2004 | Chen | |
| 2005/0282026 | A1 | 12/2005 | Wuu et al. | |
| 2006/0162884 | A1 | 7/2006 | Gane et al. | |
| 2006/0168811 | A1 | 8/2006 | Ozawa et al. | |
| 2009/0297738 | A1 | 12/2009 | Song et al. | |

FOREIGN PATENT DOCUMENTS

EP 2 053 162 A1 4/2009

OTHER PUBLICATIONS

International Search Report for Application No. PCT/US2010/054787 dated Feb. 23, 2011 (10 pages).

* cited by examiner

*Primary Examiner* — Betelhem Shewareged

(57) ABSTRACT

A coated medium for inkjet printing, which includes a supporting substrate and a coating layer formed on at least one side thereof. The coating layer includes at least one binder and at least two different inorganic pigments: modified calcium carbonate (MCC) and either precipitated calcium carbonate (PCC) or clay.

20 Claims, No Drawings

COATED MEDIUM FOR INKJET PRINTING

BACKGROUND

Some recent trends in the digital inkjet technology include the advancement of colorants in inks from dye molecules to pigment particles, and high-speed digital printing in the commercial or industrial printing business. Traditional coated papers for offset printing and other analog printing industries are not able to offer good image quality, print quality and/or durability when they are printed with digital inkjet printers. The medium or paper used in an inkjet printer determines the quality of the image printed thereon.

DETAILED DESCRIPTION

The inks used in inkjet printers are typically aqueous inks, which contain a minor amount of dye or pigment colorants and a large amount of water and co-solvents as the ink vehicle. Thus, the absorption property of the papers greatly affects the print quality. Inkjet papers conventionally have a base paper coated with an ink-receiving layer, i.e., the layer onto which ink droplets are deposited, to improve the ink receptive properties of the papers. The ink-receiving layer typically contains pigment particles with high surface area or high porosity incorporated therein as the major pigment. Commonly used pigments include silica, alumina and other metal oxides. These pigments can provide a coating layer with fast absorption and enough capacity for inkjet printing. On the other hand, these pigments are more expensive, and as a result, coated papers based on these pigments are not very competitive when compared to similar grade products in traditional analog printing industries or coated media for digital printing with electrophotographic technologies. Another disadvantage is that, when coating formulations are based on these pigments with high surface area, their total solid content is usually low due to the high amount of water or solvent required for pigment dispersion. As a consequent, during the manufacturing of the coated media, a lot of energy is required to remove the water or solvent from the coating layer, thus, the coating speed is limited by the drying capability. This leads to high machine operating costs and an increase in the total cost of final products.

In order to compete with traditional analog printing or digital photographic printing, low-cost coated paper is one of the key elements to help inkjet technology to lower its total cost per page and broaden its applications in industrial printing. In the current coated paper industry, low cost coating pigments include precipitated calcium carbonate, ground calcium carbonate, kaolin clays, and others. Coating formulations based on these traditional pigments have low raw material costs. The formulations based on these low-cost pigments generally have a high solid content, usually in the range from 60 to 70 wt. %. With such a high solid content, these formulations require much less energy to remove the water after coating and enable high coating speeds. As a result, the total manufacture operating expenses can be kept to a low level. However, coated papers based on these low-cost pigments usually have a relatively dense coating structure, especially when compared with inkjet coated paper based on silica pigments with high surface area. As a result, the absorption rate of such coated paper is slow, and its absorption capacity is not high enough to meet the requirements of inkjet printing. When such coated paper is printed using an inkjet printer, the printed paper suffers several shortcomings including slow drying time, high level of coalescence and graininess in images, undesirable feathering patterns, print mottling, poor rub resistance and water resistance, to name a few.

This disclosure provides a novel, pigmented coating composition for inkjet media. When the print medium coated with this novel coating composition is used in inkjet printing, the print medium imparts high ink absorption rate (i.e., fast absorption of the liquid component in the ink, e.g. water) and exhibits improvements in image qualities after printing, including reduced graininess and improved image gloss. At the same time, the coating composition does not rely on the use of high-cost pigments such as silica or alumina. The present disclosure additionally provides a method of making a coated print medium, which includes: providing a supporting substrate; coating one or both sides of the substrate with the novel coating composition; drying the coated substrate; and optionally calendering the coated substrate.

The novel coating composition of the present disclosure is an aqueous pigmented dispersion containing at least two different inorganic pigments, one of which is a modified calcium carbonate (MCC), and at least one hydrophilic or water-soluble binder. The other inorganic pigment is either precipitated calcium carbonate (PCC) or clay. Suitable clay materials include calcined clay, kaolin clay, or other phyllosilicates appropriate to coatings. In one embodiment, the novel coating composition contains three different inorganic pigments: MCC in combination with PCC and clay. The "modified calcium carbonate" used herein refers to pre-existing calcium carbonate (ground or precipitated) which has been post-treated with phosphoric acid and $CO_2$ gas as well as a variety of other additives such as soluble silicates for the purpose of altering both the structure and the chemical composition of the original particle. This post-treatment results in a pigment particle made up of a shell of various calcium compounds surrounding a core of the original carbonate molecule. Suitable MCC material may take the form of a slurry dispersion of structured calcium minerals, which comprise primarily of calcium carbonate [$CaCO_3$], calcium phosphate and/or calcium silicate [$Ca_2SiO_4$]. Calcium phosphate includes compounds containing calcium ions together with phosphate ions, and may include, but is not limited to, octacalcium phosphate [$Ca_8H_2(PO_4)_6$-$5H_2O$]. A non-limiting example of this form of MCC is Omyajet 5010 available from Omya Inc. The total amount of inorganic pigments present in the coating composition is between 20 wt. % and 50 wt. %. "Wt. %" refers to dry weight percentage based on the total dry weight of the coating composition.

To be compatible with inkjet printing, the coated media should have a fast absorption rate and a high absorption capacity. Conventional PCC cannot satisfy these requirements because they tend to form a relatively dense packing structure in the coating layer due to the small particle size and regular orientation of the particles. Clays are usually more platy and flat, and when they are incorporated in a coating, they tend to orient in the coating in a manner that results in a very closed-off and less permeable coating. MCC alone also does not provide the print quality desired due to its large particle size and very fast absorption property. Coating with just MCC as inorganic pigment usually ends up being almost too porous, which results in significant ink strike through and ink bleeding in the printed media. In addition, MCC may also be quite friable should significant calendering be required. Significant calendering results in crushing of the particles, which in turn results in a mottled printed image. It has been discovered that multi-pigment coatings containing the combination of the MCC as described herein and PCC or clay, or both, impart the desirable absorptivity and print quality.

The novel coating composition of the present disclosure may also include, as an optional component, a polymeric co-pigment. Suitable polymeric co-pigments include plastic pigments (e.g., polystyrene, polymethacrylates, polyacrylates, copolymers thereof, and/or combinations thereof). Suitable solid spherical plastic pigments are commercially available from The Dow Chemical Company, e.g., DPP 756A or HS 3020. The amount polymeric co-pigment in the coating composition may be in the range of 1 part to 10 parts based on 100 parts of inorganic pigments.

The novel coating composition also includes one or more binders that may include, but are not limited to, hydrophilic or water-soluble binders such as polyvinyl alcohol and derivatives thereof (e.g. carboxylated polyvinyl alcohol, sulfonated polyvinyl alcohol, acetoacetylated polyvinyl alcohol, and mixtures thereof), polystyrene-butadiene, polyethylene-polyvinyacetate copolymers, starch, gelatin, casein, alginates, carboxycellulose materials, polyacrylic acid and derivatives thereof, polyvinyl pyrrolidone, casein, polyethylene glycol, polyurethanes (for example, a modified polyurethane resin dispersion), polyamide resins (for instance, an epichlorohydrin-containing polyamide), a poly(vinyl pyrrolidone-vinyl acetate) copolymer, a poly(vinyl acetate-ethylene) copolymer, a poly(vinyl alcohol-ethylene oxide) copolymer, styrene acrylate copolymer, resin latex, styrene butadiene latex or mixtures thereof, and others without restriction. In general, the binder is present in an amount sufficient to bind the inorganic pigments. In preferred embodiments, the binder is present in an amount ranging from about 10-20 parts based on 100 parts of inorganic pigments.

The novel coating composition may also include other coating additives such as surfactants, rheology modifiers, defoamers, optical brighteners, biocides, pH controlling agents, dyes, and other additives for further enhancing the properties of the coating. The total amount of optional coating additives may be in the range of 0-10 parts based on 100 parts of inorganic pigments.

Among these additives, rheology modifier is useful for addressing runnability issues. Suitable rheology modifiers include polycarboxylate-based compounds, polycarboxylated-based alkaline swellable emulsions, or their derivatives. The rheology modifier is helpful for building up the viscosity at certain pH, either at low shear or under high shear, or both. In certain embodiments, a rheology modifier is added to maintain a relatively low viscosity under low shear, and to help build up the viscosity under high shear. It is desirable to provide a coating formulation that is not so viscous during the mixing, pumping and storage stages, but possesses an appropriate viscosity under high shear. Some examples of rheology modifiers that meet this requirement include, but are not limited to, Sterocoll FS (from BASF), Cartocoat RM 12 (from Clariant), Acrysol TT-615 (from Rohm and Haas) and Acumer 9300 (from Rohm and Haas). The amount of rheology modifier in the coating composition may be in the range of 0.1-2 parts, more preferably, in the range of 0.1-0.5 parts, based on 100 parts of inorganic pigments.

The supporting substrate, on which the coating composition is applied, may take the form of a sheet or a continuous web suitable for use in an inkjet printer. The supporting substrate may be a base paper manufactured from cellulose fibers. More specifically, the base paper may be produced from chemical pulp, mechanical pulp, thermal mechanical pulp and/or the combination of chemical and mechanical pulp. The base paper may also include conventional additives such as internal sizing agents and fillers. The internal agents are added to the pulp before it is converted into a paper web or substrate. They may be chosen from conventional internal sizing agents for printing papers. The fillers may be any particular types used in conventional paper making. As a non-limiting example, the fillers may be selected from calcium carbonate, talc, clay, kaolin, titanium dioxide and combinations thereof. Other applicable substrates include cloth, nonwoven fabric, felt, and synthetic (non-cellulosic) papers. The supporting substrate may be an uncoated raw paper or a pre-coated paper. In addition, the base paper may be calendered or uncalendered.

The novel coating composition described above is applied to one side or both opposing sides of the supporting substrate to form a coating layer thereon. The double-side coated medium has a sandwich structure, i.e., both sides of the supporting substrate are coated with the same coating and both sides may be printed with images or text. The coat weight of the coating layer may be in the range of 10-45 gsm (grams per squared meter) per side. The coating composition of the present disclosure may be applied to the supporting substrate using any one of a variety of suitable coating methods, such as blade coating, air knife coating, metering rod coating, curtain coating, or another suitable technique. To get a low-cost coated medium for inkjet printing, it is necessary to have relatively low manufacturing costs in addition to formulation material costs. Therefore, it is preferred to use a low-cost coating method, like blade coating or metering rod coating, and run the coating process at high speed. For a double-side coated medium, depending on the set-up of production machine in a mill, both sides of the substrate may be coated during a single manufacture pass, or alternatively, each side may be coated in separate passes.

After the coating step, the coated medium is then subjected to a drying process to remove water and other volatile components in the coating layer and the substrate. The drying means includes, but not limited to, infrared (IR) dryers, hot surface rolls, and hot air floatation dryers. After coating, the coated medium may be calendered to increase glossiness and/or to impart a satin surface. When a calendering step is incorporated, the coated medium may be calendered by an on-line or an off-line calender machine, which may be a soft-nip calender or a supercalender. The rolls in a calendar machine may or may not be heated, and pressure is usually applied to the calendering rolls.

Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a range of approximately 1 part to 20 parts should be interpreted to include not only the explicitly recited concentration limits of 1 part to about 20 parts, but also to include individual concentrations such as 2 parts, 3 parts, 4 parts, etc.

The following Examples will serve to illustrate representative embodiments of the present disclosure and should not be construed as limiting of the disclosure in any way. All parts are dry parts on dry weight basis unless otherwise indicated.

EXAMPLES

Example 1

Coating composition A1, which represents an example of the novel coating composition of the present disclosure, and a comparative coating composition C1 were prepared according to the formulations set forth in TABLE 1. The formulation for Comparative C1 was similar to that of A1 except that MCC was replaced with a 50/50 mixture of two different silica gels, Gasil 23F from Ineos Silicas and silica A25 from Grace Davison.

TABLE 1

| Components | A1 (parts) | Comparative C1 (parts) |
|---|---|---|
| PCC (Opacarb A40[1]) | 50 | 50 |
| Silica gel[2] | 0 | 20 |
| MCC (Omyajet 5010[3]) | 20 | 0 |
| Calcined clay (Ansilex 93[4]) | 30 | 30 |
| Plastic Pigment (DPP 756A[5]) | 5 | 5 |
| Styrene acrylic latex (Acronal S728[6]) | 11 | 11 |
| Polyvinyl alcohol (Mowiol 40-88[7]) | 0.5 | 0.5 |
| Dispersant (Acumer 9300[8]) | 0.2 | 0.2 |
| KOH | 0.5 | 0.5 |
| Surfactant 10G[9] | 0.3 | 0.3 |
| Foammaster VF[10] | 0.3 | 0.3 |
| Tinopal ABP[11] | 0.5 | 0.5 |
| Viscosifier (Sterocoll FS[12]) | 0.2 | 0.2 |

[1]available from Specialty Minerals
[2]50/50 mixture of Gasil 23F (Ineos Silicas) and silica A25 (Grace Davison)
[3]available from Omya Inc.
[4]available from BASF Corp.
[5]available from Dow Chemical
[6]available from BASF Corp.
[7]available from Clariant
[8]sodium salt of polyacrylic acid from Rohm and Haas.
[9]available from Dixie Chemical Co.
[10]defoamer available from Cognis.
[11]optical brightening agent available from Ciba Specialty Chemicals
[12]acrylic acid/alkyl acrylate copolymer available from BASF Corp.

The components in the coating formulations were mixed with water to obtain dispersions with 54% solids. Each coating composition was applied onto an uncoated, lightly calendered paper base. The coating was applied using a blade coater to obtain a coating layer with a coat weight of about 20 gsm. The coated paper samples were dried and then calendered at 2500 psi (pounds per square inch), 130° F., 1 pass The final coated paper samples were printed on an Officejet Pro 8000 printer (Hewlett-Packard Co.) with color pigment inks. The print performance was measured and the results are shown in TABLE 2 below.

TABLE 2

| Formulation | Color Gamut | KOD | 75° Image Gloss | Orange "Grain" |
|---|---|---|---|---|
| A1 | 457541 | 1.825 | 95.1 | 9.95 |
| Comparative C1 | 416121 | 1.617 | 85.1 | 26.29 |

The color gamut was measured as the volume of the CIE L*a*b* space based on the X-Rite 938 (X-Rite Co.) colorimetry measurement of 8 color blocks printed on the paper. KOD or black optical density was also measured using the same X-Rite 938 device. 75° Image Gloss was measured using a BYK-Gardner 75° gloss meter. Orange "Grain" (measurement of graininess) was measured by printing a solid block of "orange" ink, then optically scanning the printed block. The grain value is calculated from the Fourier noise power spectrum of the pixels, which has been filtered to match human visual perception. The higher the "Grain" score, the more inhomogeneous the print image (i.e., "grainy"), the lower the grain score the more homogenous the printed area. As can be seen from TABLE 2, printing on the paper sample coated with formulation A1 (which contains MCC) produced significant improvements in color gamut, KOD, gloss and graininess, as compared to printing on the paper sample coated with formulation C1 (which does not contain MCC).

Example 2

In this example, a coating containing MCC as the only inorganic pigment was compared to that containing PCC as the only pigment. Two coating formulations (M and P) were prepared according to the formulations shown in TABLE 3.

TABLE 3

| Components | M (parts) | P (parts) |
|---|---|---|
| PCC (Opacarb A40[1]) | 0 | 100 |
| MCC (Omyajet 5010[2]) | 100 | 0 |
| Polyvinyl alcohol (Mowiol 40-88[3]) | 13.5 | 13.5 |
| Surfactant 10G[4] | 0.25 | 0.25 |
| Ultralube E846[5] (coefficient-of-friction reducer) | 15 | 15 |

[1,2,3,4]as defined in Example 1
[5]Polyethylene wax available from Keim Additec The coating components in TABLE 3 were mixed with water to produce dispersions with 20% solids. Each coating compositions was coated onto a paper base at 16 gsm using a #52 Meyer Rod and then the coated paper sample was calendered at 2500 psi, 130° F., 1 pass to provide gloss. The final coated paper samples were measured for sheet gloss and then printed on an Officejet Pro 8000 printer (Hewlett-Packard Co.) with color pigment inks as in Example 1. The printed paper samples were analyzed for print quality (color gamut, KOD) and the results are summarized in TABLE 4.

TABLE 4

| Formulation | Sheet Gloss (75°) | Gamut | KOD |
|---|---|---|---|
| M | 26 | 218605 | 1.2 |
| P | 34 | 266368 | 1.4 |

In this case, having MCC as the only inorganic pigment in a simplified formulation produced print quality that was worse than the coating formulation containing PCC as the only inorganic pigment.

Example 3

Four formulations (P3, U3, G3, M3) were prepared according to the formulations shown in TABLE 5.

TABLE 5

| Components | P3 (parts) | U3 (parts) | G3 (parts) | M3 (parts) |
|---|---|---|---|---|
| PCC (Opacarb A40[1]) | 50 | 50 | 50 | 50 |
| PCC (SoCal 31[2]) | 20 | 0 | 0 | 0 |
| Ultrafine PCC (Omyacarb C4440[3]) | 0 | 20 | 0 | 0 |
| GCC (Hydrocarb 60[4]) | 0 | 0 | 20 | 0 |
| MCC (Omyajet 5010[5]) | 0 | 0 | 0 | 20 |
| Calcined clay (Ansilex 93[6]) | 30 | 30 | 30 | 30 |
| Plastic Pigment (DPP 756A[7]) | 5 | 5 | 5 | 5 |
| Styrene acrylic latex (Acronal S728[8]) | 11 | 11 | 11 | 11 |
| Dispersant (Acumer 9300[9]) | 0.2 | 0.2 | 0.2 | 0.2 |
| KOH | 0.5 | 0.5 | 0.5 | 0.5 |
| Polyvinyl alcohol (Mowiol 40-88[10]) | 0.5 | 0.5 | 0.5 | 0.5 |
| Surfactant 10G[11] | 0.3 | 0.3 | 0.3 | 0.3 |

TABLE 5-continued

| Components | P3 (parts) | U3 (parts) | G3 (parts) | M3 (parts) |
|---|---|---|---|---|
| Foammaster VF[12] | 0.3 | 0.3 | 0.3 | 0.3 |
| Tinopal ABP[13] | 0.5 | 0.5 | 0.5 | 0.5 |
| Viscosifier (Sterocol FS[14]) | 0.2 | 0.2 | 0.2 | 0.2 |

[1,5,6,7,8,9,10,11,12,13,14]as defined in Example 1

[2]available from Solvay Chemicals

[3]available from Omya Inc.

[4]Ground Calcium Carbonate (GCC) available from Omya Inc.

The coating components in TABLE 5 were mixed with water to produce dispersions with 54% solids. Each coating composition was coated onto a paper base using a blade coater to form a coating layer having a coat weight of approximately 20 gsm. The coated paper samples were dried and then calendered at 3200 psi, 130° F., 2 passes. The final coated paper samples were assessed for ink absorption rate using a Bristow Wheel absorption test method and Hewlett-Packard ink HP 940 (Cyan). Bristow absorption is described in detail in Bristow, J. A., 1967, "Liquid absorption into paper during short time intervals," Svensk Paperstidning, v 70, pp 623-629. In the Bristow test, a special type of ink jet head box is initially filled with a metered amount of the fluid under study. This head box is then placed in contact with the porous ink-receiving surface under study, and this surface is attached to a rotating wheel. By measuring the length of an ink trace for a number of different wheel speeds, a plot of the amount of fluid transferred into the porous material versus the time that the ink jet head box is in contact with the porous material can be developed for each of the wheel speeds. From this information, three parameters relating to the fluid penetration dynamics may be obtained, namely: (1) the volumetric roughness of the print medium, (2) the wetting delay of fluid penetration into the print medium and (3) the fluid penetration rate into the print medium. In the present case, one "contact time" of 2 seconds was chosen for comparison so absorptions are recorded in ml/m$^2$. The higher the absorption value, the "faster" the absorption, which is the desired effect. The results are shown in TABLE 6.

TABLE 6

| Coating formulation | Bristow Absorption (ml/m$^2$) |
|---|---|
| M3 | 15 |
| P3 | 12 |
| U3 | 12 |
| G3 | 8 |

It can be seen from TABLE 6 that the incorporation of MCC in the multi-pigment formulation improved ink absorption as compared to formulations containing conventional PCC pigments and GCC pigment.

Example 4

Coating composition A4 and comparative coating composition C4 were prepared according to the formulations shown in TABLE 7.

TABLE 7

| Components | A4 (parts) | Comparative C4 (parts) |
|---|---|---|
| PCC (Opacarb A40[1]) | 55 | 70 |
| MCC (Omyajet 5010[2]) | 15 | 0 |

TABLE 7-continued

| Components | A4 (parts) | Comparative C4 (parts) |
|---|---|---|
| Calcined clay (Ansilex 93[3]) | 30 | 30 |
| Plastic Pigment (DPP 756A[4]) | 5 | 5 |
| Styrene acrylic latex (Acronal S728[5]) | 11 | 11 |
| Acumer 9300[6] | 0.2 | 0.2 |
| KOH | 0.5 | 0.5 |
| Polyvinyl alcohol (Mowiol 40-88[7]) | 0.5 | 0.5 |
| Surfactant 10G[8] | 0.3 | 0.3 |
| Foammaster VF[9] | 0.3 | 0.3 |
| Tinopal ABP[10] | 0.5 | 0.5 |
| Sterocol FS[11] | 0.2 | 0.2 |

[1-11]as defined in Example 1

The coating components in TABLE 7 were mixed with water to produce dispersions with 54% solids. Each coating formulation was coated onto a paper base to obtain a coat weight of about 20 gsm using the same coating, drying and calendering procedures described in Example 2 (2500 psi/130° F./1 pass). The final coated paper samples were printed on an Officejet Pro 8000 printer (Hewlett-Packard Co.) with color pigment inks and the print quality (color gamut, KOD) was analyzed. The results are summarized in TABLE 8.

TABLE 8

| Formulation | Gamut | KOD |
|---|---|---|
| A4 (MCC + PCC + clay) | 460647 | 1.79 |
| C4 (PCC + clay) | 449703 | 1.75 |

The results in TABLE 8 show that the paper sample with coating containing PCC, MCC and clay yielded better color performance (gamut) and better black optical density (KOD) than the paper sample with coating containing just PCC and clay.

Example 5

Coating composition A5 and comparative coating composition C5 were prepared according to the formulations shown in TABLE 9.

TABLE 9

| Components | A5 (parts) | Comparative C5 (parts) |
|---|---|---|
| PCC (Opacarb A40[1]) | 0 | 70 |
| MCC (Omyajet 5010[2]) | 70 | 0 |
| Calcined clay (Ansilex 93[3]) | 30 | 30 |
| Plastic Pigment (DPP 756A[4]) | 5 | 5 |
| Styrene acrylic latex (Acronal S728[5]) | 11 | 11 |
| Acumer 9300[6] | 0.2 | 0.2 |
| KOH | 0.5 | 0.5 |
| Polyvinyl alcohol (Mowiol 40-88[7]) | 0.5 | 0.5 |
| Surfactant 10G[8] | 0.3 | 0.3 |
| Foammaster VF[9] | 0.3 | 0.3 |
| Tinopal ABP[10] | 0.5 | 0.5 |
| Sterocol FS[11] | 0.2 | 0.2 |

[1-11]as defined in Example 1

The coating components in TABLE 9 were mixed with water to produce dispersions with 54% solids. Each coating composition was coated onto a paper base using a blade coater to form a coating layer with approximately 20 gsm coat weight. The coated paper samples were dried and then calendered at 2500 psi, 130° F., 1 passes. The final coated paper samples were assessed for absorption rate using the Bristow Wheel test method and HP ink HP 940 (Cyan) as described in Example 3, and the results are shown in TABLE 10.

TABLE 10

| Formulation | Bristow Absorption ($ml/m^2$) |
|---|---|
| A5 (MCC + Clay) | 12 |
| C5 (PCC + Clay) | 10 |

The results in TABLES 10 show that MCC combined with clay yielded better absorption than the combination of PCC and clay.

Example 6

A coating composition A6 was prepared using MCC and clay as the only inorganic pigments and in accordance with the formulation shown in TABLE 11.

TABLE 11

| Components | A6 (parts) |
|---|---|
| MCC (Omyajet 5010[1]) | 70 |
| Calcined clay (Ansilex 93[2]) | 30 |
| Plastic Pigment (DPP 756A[3]) | 5 |
| Styrene acrylic latex (Acronal S728[4]) | 11 |
| Acumer 9300[5] | 0.2 |
| KOH | 0.5 |
| Polyvinyl alcohol (Mowiol 40-88[6]) | 0.5 |
| Surfactant 10G[7] | 0.3 |
| Foammaster VF[8] | 0.3 |
| Tinopal ABP[9] | 0.5 |
| Sterocol FS[10] | 0.2 |

[1-10]as defined in Example 1

The coating components in TABLE 11 were mixed with water to produce a dispersion with 54% solids. The coating composition was coated onto a paper base using a blade coater to form a coating layer with approximately 20 gsm coat weight. The coated paper sample was dried and then calendered at 2500 psi, 130° F., 1 pass. The sample was printed on an Officejet Pro 8000 printer (Hewlett-Packard Co.) with color pigment inks and the print quality (color gamut, KOD) was analyzed. The results are summarized in TABLE 12. The print quality is very good with excellent gamut (color) and black optical density (KOD).

TABLE 12

| Formulation | Gamut | KOD |
|---|---|---|
| A6 | 384432 | 1.66 |

Although the present disclosure describes certain representative embodiments and examples, it will be understood to those skilled in the art that various modifications may be made to these representative embodiments and examples without departing from the scope of the appended claims.

What is claimed is:

1. A coated medium for inkjet printing, comprising:

a supporting substrate; and a coating layer formed on at least one side of the supporting substrate, said coating layer comprising at least one binder and three different inorganic pigments: precipitated calcium carbonate (PCC), clay, and modified calcium carbonate (MCC);

wherein said modified calcium carbonate (MCC) is composed of structured calcium minerals, which comprise calcium carbonate [$CaCO_3$] and calcium phosphate.

2. The coated medium of claim 1, wherein said coated medium imparts a Bristow absorption rate of about 15 $ml/m^2$ based on a Bristow Wheel absorption test method.

3. The coated medium of claim 1, wherein said clay is selected from the group consisting of calcined clay, kaolin clay, and phyllosilicates.

4. The coated medium of claim 1, wherein said supporting substrate is a paper substrate containing cellulose fibers.

5. The coated medium of claim 1, wherein said coating layer comprises two different binders selected from the group consisting of water-soluble and hydrophilic binders.

6. The coated medium of claim 1, wherein said coating layer further comprises a polymeric co-pigment in an amount from about 1 part to about 10 parts based on 100 parts of total inorganic pigments.

7. The coated medium of claim 1, wherein total amount of inorganic pigments present in the coating layer is from about 20 wt. % to about 50 wt. % based on the total dry weight of the coating layer.

8. The coated medium of claim 1, wherein said binder is present in the coating layer in an amount ranging from about 10 parts to about 20 parts based on 100 parts of inorganic pigments.

9. A coated medium for inkjet printing, comprising:

a supporting substrate; and a coating layer formed on at least one side of the supporting substrate, said coating layer comprising at least one binder and at least two different inorganic pigments: modified calcium carbonate (MCC) and either precipitated calcium carbonate (PCC) or clay;

wherein said modified calcium carbonate (MCC) is composed of structured calcium minerals, which comprise calcium carbonate [$CaCO_3$] and calcium phosphate.

10. The coated medium of claim 9, wherein said coated medium imparts a Bristow absorption rate of about 15 $ml/m^2$ based on a Bristow Wheel absorption test method.

11. The coated medium of claim 9, wherein said clay is selected from the group consisting of calcined clay, kaolin clay, and phyllosilicates.

12. The coated medium of claim 9, wherein said supporting substrate is a paper substrate containing cellulose fibers.

13. The coated medium of claim 9, wherein said binder is selected from the group consisting of water-soluble and hydrophilic binders.

14. The coated medium of claim 13, wherein said coating layer comprises two different binders.

15. The coated medium of claim 9, wherein said coating layer further comprises a polymeric co-pigment in an amount from about 1 part to about 10 parts based on 100 parts of total inorganic pigments.

16. A method for forming a coated medium for inkjet printing, comprising:

(a) preparing an aqueous coating composition comprising at least one binder and at least two different inorganic pigments: modified calcium carbonate (MCC) and either precipitated calcium carbonate (PCC) or clay, wherein said modified calcium carbonate (MCC) is composed of structured calcium minerals, which comprise calcium carbonate [$CaCO_3$] and calcium phosphate;

(b) applying the coating composition to a surface of a supporting substrate; and (c) drying the coated substrate to form an ink-receiving layer on the substrate.

17. The method of claim 16 further comprising calendering the coated substrate after drying.

18. The coated medium of claim 9 wherein the modified calcium carbonate (MCC) is composed of structured calcium minerals that include calcium carbonate and octacalcium phosphate.

19. The coated medium of claim 9 wherein the coating layer has a coat weight ranging from 10 gsm to 45 gsm.

20. The coated medium of claim 1 wherein the modified calcium carbonate (MCC) is composed of structured calcium minerals that include calcium carbonate and octacalcium phosphate.

* * * * *